US009484175B2

(12) United States Patent
Onoda

(10) Patent No.: US 9,484,175 B2
(45) Date of Patent: Nov. 1, 2016

(54) FUSE CIRCUIT ASSEMBLY

(75) Inventor: Shinya Onoda, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 218 days.

(21) Appl. No.: 14/114,024

(22) PCT Filed: Apr. 25, 2012

(86) PCT No.: PCT/JP2012/061118

§ 371 (c)(1),
(2), (4) Date: Oct. 25, 2013

(87) PCT Pub. No.: WO2012/147808

PCT Pub. Date: Nov. 1, 2012

(65) Prior Publication Data

US 2014/0043134 A1 Feb. 13, 2014

(30) Foreign Application Priority Data

Apr. 27, 2011 (JP) ..... 2011-099446

(51) Int. Cl.

| | |
|---|---|
| ***H01H 85/044*** | (2006.01) |
| ***H01H 85/10*** | (2006.01) |
| ***H01H 85/12*** | (2006.01) |
| *H01H 85/147* | (2006.01) |
| *H01H 85/153* | (2006.01) |
| *H01H 85/055* | (2006.01) |

(52) U.S. Cl.

CPC ..... *H01H 85/044* (2013.01); *H01H 85/10* (2013.01); *H01H 85/12* (2013.01); *H01H 85/147* (2013.01); *H01H 85/153* (2013.01); *H01H 2085/0555* (2013.01)

(58) Field of Classification Search

CPC .... H01H 85/044; H01H 85/10; H01H 85/12; H01H 2085/0555; H01H 85/153; H01H 85/147; H01H 2085/266; H01H 31/127; H01H 39/00; H01H 39/002; H01H 71/122; H01H 85/22; H01H 85/26; H01H 85/263; H01H 85/28

USPC ..... 337/283; 361/41, 626, 628

See application file for complete search history.

(56) References Cited

U.S. PATENT DOCUMENTS 4,204,183 A * 5/1980 Blewitt ..... H01H 85/10 337/159
2004/0130430 A1* 7/2004 Matsumura ..... H01H 85/044 337/181

(Continued)

FOREIGN PATENT DOCUMENTS

GB 445902 A * 4/1936 ..... H01H 85/10
JP 2004-127698 A 4/2004
JP 2011-78189 A 4/2011

OTHER PUBLICATIONS

International Search Report for PCT/JP2012/061118 dated Jul. 24, 2012.

*Primary Examiner* — Jerry Wu
*Assistant Examiner* — Stephen Sul
(74) *Attorney, Agent, or Firm* — Sughrue Mion, PLLC

(57) ABSTRACT

A fuse circuit assembly (1) includes: a linking plate (11) configured to carry a current input from an input part (14), the linking plate (11) having a shape tapered with distance from the input part (14) in a flow direction of the current input from the input part (14); a plurality of fusible members (12) each configured to be fused by a current of a predetermined magnitude flowing through each fusible member (12); and a plurality of terminals (13) connected to the linking plate (11) through the plurality of fusible members (12) from locations of the linking plate (11) positioned at intervals in the flow direction.

5 Claims, 2 Drawing Sheets

(56) References Cited

U.S. PATENT DOCUMENTS

2008/0030295 A1* 2/2008 Matsumoto ..... H01H 85/044
337/290

2009/0230808 A1* 9/2009 Tatebe ..... H02K 3/12
310/201

2011/0073345 A1 3/2011 Sato et al.

* cited by examiner

FUSE CIRCUIT ASSEMBLY

CROSS REFERENCE TO RELATED APPLICATIONS

This application is a National Stage of International Application No. PCT/JP2012/061118 filed Apr. 25, 2012, claiming priority based on Japanese Patent Application No. 2011-099446 filed Apr. 27, 2011, the contents of all of which are incorporated herein by reference in their entirety.

TECHNICAL FIELD

The present invention relates to a fuse circuit assembly connected to terminals through fusible members that are fused by a current of a predetermined magnitude flowing therethrough.

BACKGROUND ART

For example, a vehicle as a moving body is equipped with a battery that acts as a power supply source for supplying electricity to various on-board electronic apparatuses and the like. The battery is electrically connected to wires connected to the electronic apparatuses and the like, for example, through a fusible link unit, so that the electricity is supplied from the battery to the electronic apparatuses and the like.

A fusible link unit described in Patent Literature 1 is proposed as the fusible link unit described above. This fusible link unit distributes the electricity from a battery to electronic apparatuses and the like through a fuse circuit assembly.

FIG. 1 is a view illustrating the fuse circuit assembly in the fusible link unit described in Patent Literature 1. As illustrated in FIG. 1, a fuse circuit assembly 100 substantially includes: a narrow rectangular linking plate 111; a plurality of fusible members 112, each of which fuses when a current of a current value equal to or larger than a predetermined value flows therethrough; and a plurality of female terminals 113*a* and screw fixing terminals 113*b* that are connected to the linking plate 111 in a chain fashion through the corresponding fusible members 112.

The fuse circuit assembly 100 is disposed in a housing (not illustrated), and supplies electricity input from both an input part (not illustrated) connected to a battery and an input part 114 connected to an alternator to electronic apparatuses and the like, each of which is connected to the female terminal 113*a* or the screw fixing terminal 113*b*.

In the case where a current of a current value equal to or larger than the predetermined value flows through one of the fusible members 112, this fusible member 112 is fused by the heat generated therein. As a result, the supply of the excess electricity to the electronic apparatus or the like is prevented.

CITATION LIST

Patent Literature

Patent Literature 1: Japanese Unexamined Patent Application Publication No. 2004-127698

SUMMARY OF INVENTION

While a vehicle is moving, the relevant fuse circuit assembly 100, as described above, sequentially routes a current input from the input part 114 to each terminal 113 in order from the terminal 113 on the input part 114 side, through the linking plate 111 (see arrows Z in FIG. 1).

The linking plate 111 has a uniform resistance therein, because its width is formed evenly. For this reason, a current value routed from the input part 114 to each terminal 113 decreases with distance from the input part 114.

As described above, the current value routed to each terminal 113 decreases with distance from the input part 114. Therefore, one of the fusible members 112 which is closer to the input part 114 may fuse faster than a farther one, even if the fusible members 112 have the same rated current value. For this reason, it is desirable to suppress a variation in the fusing characteristic among the fusible members 112 from affecting the electronic apparatuses and the like.

An object of the present invention is to provide a fuse circuit assembly that can suppress a variation in the fusing time among fusible members.

An aspect of the present invention is a fuse circuit assembly including: a linking plate configured to carry a current input from an input part, the linking plate having a shape tapered with distance from the input part in a flow direction of the current input from the input part; a plurality of fusible members each configured to be fused by a current of a predetermined magnitude flowing through each fusible member; and a plurality of terminals connected to the linking plate through the plurality of fusible members from locations of the linking plate positioned at intervals in the flow direction.

According to the above aspect, the linking plate is formed so as to be tapered with distance from the input part in the flow direction of the current input from the input part. Therefore, the linking plate equally places the overloads on the fusible members, so that a variation in the fusing time among fusible members is suppressed.

Consequently, it is possible to provide a fuse circuit assembly that can suppress a variation in the fusing time among the fusible members.

The linking plate may be configured to carry currents from a battery and an alternator, and the input part may be connected to the alternator.

According to the above configuration, the linking plate is formed so as to be tapered with distance from the input part in the flow direction of the current from the input part connected to the alternator. Therefore, the linking plate equally places the overloads on the fusible members, for the electricity from the input part connected to the alternator for supplying a particularly large amount of electricity, thereby being able to suppress a variation in the fusing time among the fusible members.

The linking plate may have the shape tapered in accordance with a current value of the current flowing in the linking plate.

According to the above configuration, the linking plate is formed so as to be tapered in accordance with the current value of the current flowing in the linking plate. Therefore, the linking plate can equally place the overloads on the fusible members with high accuracy, thereby suppressing a variation in the fusing time among the fusible members.

DESCRIPTION OF EMBODIMENTS

Figure 1:
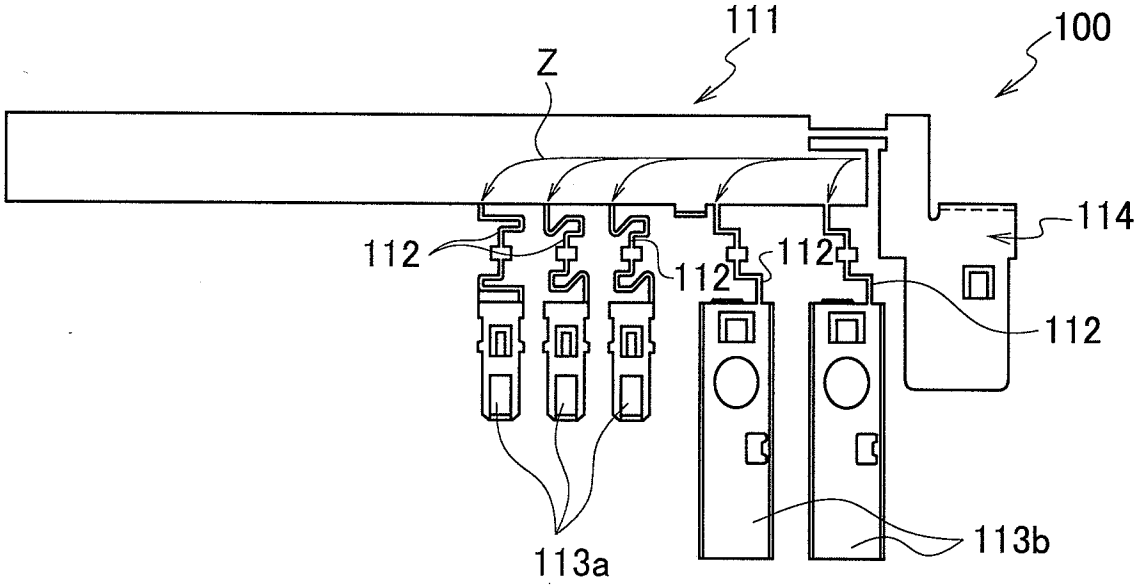
FIG. 1 RELATED ART
FIG. 1 is a front view illustrating a fuse circuit assembly of a relevant fusible link unit.
Figure 2:
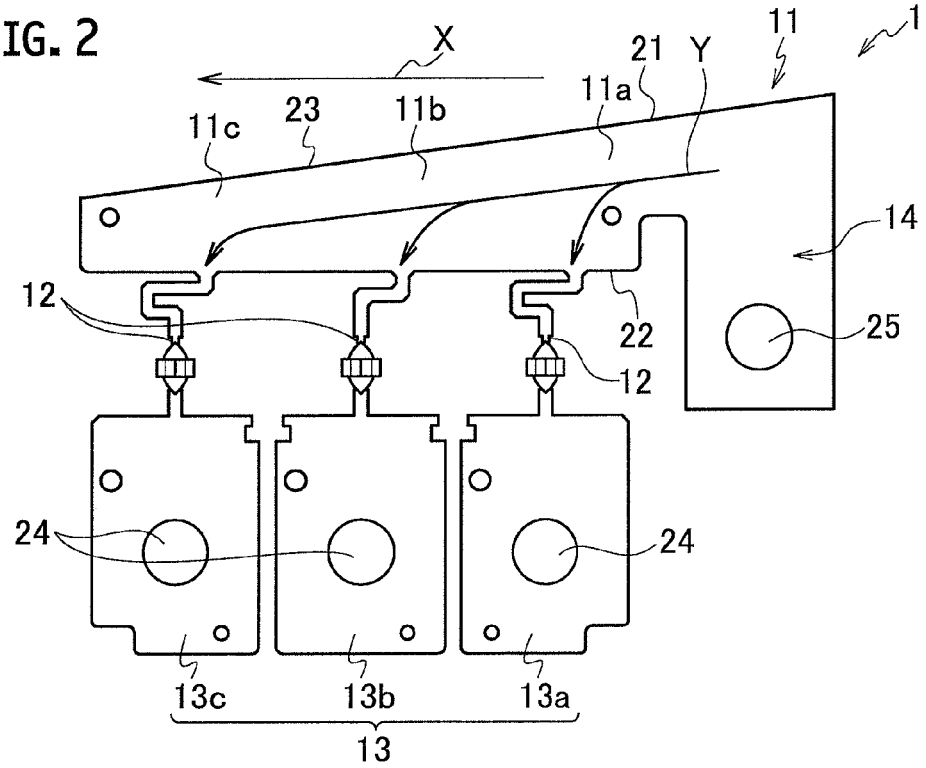
FIG. 2 is a front view illustrating a fuse circuit assembly according to an embodiment of the present invention.

Hereinafter, a fuse circuit assembly according to an embodiment of the present invention will be explained with reference to the drawings. First of all, referring to FIG. 2, the fuse circuit assembly according to the embodiment of the present invention will be explained in detail. FIG. 2 is a front view illustrating the fuse circuit assembly according to the embodiment of the present invention.

The fuse circuit assembly according to the embodiment of the present invention is a fuse circuit assembly that supplies electricity to electronic apparatuses and the like by carrying currents from a battery and an alternator, and prevents excess electricity from being supplied to the electronic apparatus and the like by causing fusible members to be fused by a current of a predetermined magnitude.

As illustrated in FIG. 2, a fuse circuit assembly (bus bar) 1 substantially includes: a linking plate 11 (11*a* to 11*c*) to which respective currents flow from a battery and an alternator; a plurality of fusible members (fuses) 12 each of which can be fused by a current of a predetermined magnitude flowing therein; and a plurality of terminals 13 (13*a* to 13*c*) connected to the linking plate 11 through the corresponding fusible members 12.

The fuse circuit assembly 1 is formed by processing a conductive metal plate. The fuse circuit assembly 1 is placed in a housing (not illustrated) made of an insulating synthetic resin, and supplies electricity from the battery and the alternator to electronic apparatuses and the like installed in a vehicle.

The linking plate 11 (11*a* to 11*c*) carries currents input from both an input part (not illustrated) connected to the battery and an input part 14 connected to the alternator.

The linking plate 11 is formed so as to be tapered with distance from the input part 14 in a flow direction X of a current input from the input part 14. More particularly, one side 21 of the linking plate 11 in the width direction thereof is provided with an angled part 23 formed to be angled with respect to the other side 22, so that the linking plate 11 is tapered in accordance with a current value of a current flowing in the linking plate 11.

If the linking plate has an even width, its resistance is uniform at any given parts. Accordingly, the current value of the current routed from the input part 14 decreases with distance from the input part 14.

In contrast, the linking plate 11 according to the embodiment of the present invention is formed so as to be tapered with distance from the input part 14 in the flow direction X of the current input from the input part 14.

Therefore, the currents of substantially the same current value are routed from the input part 14 to the terminals 13 through the interior of the linking plate 11. Thus, the linking plate 11 equally places the overloads on the fusible members, thereby being able to suppress a variation in the fusing time among the fusible members.

The respective fusible members 12 are connected to the linking plate 11 from locations of the linking plate 11 positioned at intervals in the flow direction X of the current input from the input part 14.

Each fusible member 12 has the shape of a narrow crank, and a low melting point metal is fastened to a midway point of each crank shape in a caulking manner. When a current of a current value equal to or larger than a predetermined value flows through one of the fusible members 12, this fusible member 12 fuses, thereby preventing excess electricity from being supplied to the electronic apparatus or the like.

The fusible members 12 are disposed between the linking plate 11 and the corresponding linking plates 13 and within the same plane as the linking plate 11 without being inclined with respect to the other side 22 of the linking plate 11.

The terminals 13 are connected to the linking plate 11 in a chain fashion from the locations of the linking plate 11 positioned at intervals in the flow direction X of the current input from the input part 14, through the corresponding fusible members 12.

Each terminal 13 is provided with an apparatus connecting through-hole 24 formed for connection with a terminal (not illustrated) of the electronic apparatus installed in the vehicle. Each apparatus connecting through-hole 24 is formed to pass through the corresponding terminal 13 in the thickness direction thereof, and is connected to the terminal of the electronic apparatus through an LA terminal (not illustrated) when a bolt (not illustrated) is inserted into each apparatus connecting through-hole 24.

The input part 14 is provided with an alternator connecting through-hole 25 formed for connection with the alternator. The alternator connecting through-hole 25 is formed to pass through the input part 14 in the thickness direction thereof, and is connected to an LA terminal (not illustrated) of a cable for the alternator when a bolt (not illustrated) is inserted into the alternator connecting through-hole 25.

The fuse circuit assembly 1 configured above distributes and supplies the electricity from the battery and the alternator to the electronic apparatuses and the like through the fuse circuit assembly 1. When the electricity decreases in the battery, the alternator supplies the electricity to the battery.

Thus, the electricity supplied from the alternator is larger in amount than that from the battery. Accordingly, in the linking plate 11 according to the embodiment of the present invention, the angled part 23 is formed to be tapered with distance from the input part 14 connected to the alternator in the flow direction X of the current from the input part 14.

As a result, the linking plate 11 can equally place the overloads on the fusible members 12 for the electricity from the input part 14 connected to the alternator for supplying a particularly large amount of electricity. This makes it possible to suppress a variation in the fusing time among the fusible members 12.

Figure 3:
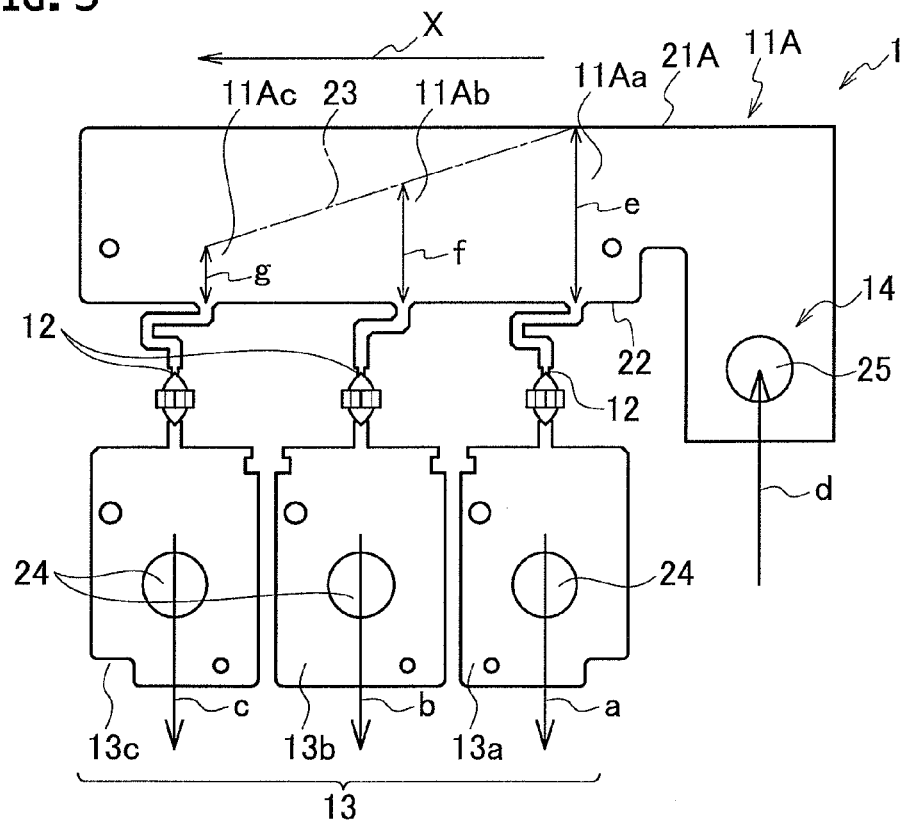
FIG. 3 is a front view for explaining a width of a linking plate in the fuse circuit assembly according to the embodiment of the present invention.

Next, referring to FIG. 3, a detailed explanation will be given of a width of the linking plate 11 in the fuse circuit assembly 1 according to the embodiment of the present invention. FIG. 3 is a front view for explaining the width of the linking plate 11 in the fuse circuit assembly 1 according to the embodiment of the present invention.

As illustrated in FIG. 3, the linking plate 11 in the fuse circuit assembly 1 according to the embodiment of the present invention will be explained using, as an example, a linking plate 11A formed such that one side 21A is parallel to the other end 22 in the width direction (i.e. linking plates 11Aa to 11Ac have the same width). When a current from the input part 14 flows into a linking plate 11A having an even width, the current is sequentially routed to the terminal 13*a* on the input part 14 side, the terminal 13*b*, and the terminal 13*c* in order, through the linking plate 11A (see the arrows Y in FIG. 2). As a result, the currents of different current values are individually routed to the terminals 13*a*, 13*b* and 13*c*.

For example, assuming that a current of 120 A flows into the linking plate 11A having the even width from the input part 14 (see an arrow d in FIG. 3), the currents of 60 A, 40

A and 20 A are individually routed to the terminals 13*a* (see an arrow a in FIG. 3), 13*b* (see an arrow b in FIG. 3) and 13*c* (see an arrow c in FIG. 3), respectively. In this case, the respective fusing characteristics (i.e. fusing time) of the fusible members 12 may vary.

Accordingly, the linking plate 11 according to the embodiment of the present invention is formed to have a width according to the respective current values of the currents routed to the terminals 13*a*, 13*b* and 13*c*. In other words, the linking plate 11*a* (see an arrow e in FIG. 3) connected to the terminal 13*a* is formed to have a width according to the current value of the current routed to the terminal 13*a*; the linking plate 11*b* (see an arrow f in FIG. 3) connected to the terminal 13*b* is formed to have a width according to the current value of the current routed to the terminal 13*b*; and the linking plate 11*c* (see an arrow g in FIG. 3) connected to the terminal 13*c* is formed to have a width according to the current value of the current routed to the terminal 13*c*.

In more detail, in the case where the current values of the currents routed to the terminals 13*a* to 13*c* are at a ratio of 3:2:1 (e.g., 60 A:40 A:20 A) by the linking plate 11A having the even width, the angled part 23 is formed such that a ratio of the respective widths of the linking plates 11*a* to 11*c* (see the arrows e to g in FIG. 3) becomes 3:2:1.

As a result, the currents having the same current value are routed from the input part 14 to the terminals 13 through the interior of the linking plate 11. Thus, the linking plate 11 equally places the overloads on the fusible members 12, thereby being able to suppress a variation in the fusing time among the fusible members 12.

As described above, the linking plate 11 is formed so as to be tapered in accordance with the current value of the current flowing in the linking plate 11. Therefore, the linking plate 11 can equally place the overloads on the fusible members 12 with high accuracy, thereby suppressing a variation in the fusing time among the fusible members 12.

The fuse circuit assembly 1, as described above, according to the embodiment of the present invention includes: the linking plate 11 through which the current input from the input part 14 flows; and the plurality of terminals 13 connected to the linking plate 11 through the corresponding fusible members 12 each of which is fused by a current of the predetermined magnitude flowing therethrough from the locations of the linking plate 11 positioned at intervals in the flow direction of the current input from the input part 14. Further, the linking plate 11 is formed so as to be tapered with distance from the input part 14 in the flow direction.

In the fuse circuit assembly 1 according to the embodiment of the present invention, the currents from the battery and the alternator flow through the linking plate 11; and the input part 14 is connected to the alternator.

In the fuse circuit assembly 1 according to the embodiment of the present invention, the linking plate 11 is formed so as to be tapered in accordance with the current value of the current flowing in the linking plate 11.

According to the fuse circuit assembly 1 according to the embodiment of the present invention, the linking plate 11 is formed so as to be tapered with distance from the input part 14 in the flow direction of the current input from the input part 14. As a result, the linking plate 11 equally places the overloads on the fusible members 12, thereby being able to suppress a variation in the fusing time among the fusible members 12.

Consequently, it is possible to provide the fuse circuit assembly 1 that can suppress a variation in the fusing time among the fusible members 12.

According to the fuse circuit assembly 1 according to the embodiment of the present invention, the linking plate 11 is formed so as to be tapered with distance from the input part 14 connected to the alternator in the flow direction of the current input from the input part 14. Therefore, the linking plate 11 can equally place the overloads on the fusible members 12 for the electricity from the input part 14 connected to the alternator for supplying a particularly large amount of electricity. This makes it possible to suppress a variation in the fusing time among the fusible members 12.

According to the fuse circuit assembly 1 according to the embodiment of the present invention, the linking plate 11 is formed so as to be tapered in accordance with the current value of the current flowing in the linking plate 11. Therefore, the linking plate 11 can equally place the overloads on the fusible members 12 with high accuracy, thereby being able to suppress a variation in the fusing time among the fusible members 12.

Hereinabove, the fuse circuit assembly of the present invention has been explained based on the illustrative embodiment. However, the present invention is not limited to this embodiment, and the configuration of each part can be replaced by any given part having the similar function.

In the above embodiment of the present invention, the explanation has been given regarding the case where the angled part 23 is formed such that the linking plate 11 is continuously tapered with distance from the input part in the flow direction X of the current input from the input part; however, the present invention is not limited to the above angled part 23.

For example, the side 21 of the linking plate 11 in the width direction thereof may be formed in a stepped shape so as to become uneven in the flow direction X of the current from the input part 14, so that the linking plate 11 is tapered in accordance with the current value of the current flowing in the linking plate 11.

The entire content of Japanese Patent Application No. 2011-099446 (filed on Apr. 27, 2011) is herein incorporated by reference.

The invention claimed is:

1. A fuse circuit assembly comprising:

a linking plate configured to carry a current input from an input part;

a plurality of fusible members each configured to be fused by a current of a predetermined magnitude flowing through each fusible member; and a plurality of terminals connected to the linking plate through the plurality of fusible members from locations of the linking plate positioned at intervals in a flow direction of the current input from the input part, wherein the linking plate has a width tapered with distance from the input part in the flow direction such that currents of a same current value are routed from the input part to the plurality of terminals through an interior of the linking plate.

2. The fuse circuit assembly according to claim 1, wherein the linking plate is configured to carry currents from a battery and an alternator, and the input part is connected to the alternator.

3. The fuse circuit assembly according to claim 1, wherein the width of the linking plate is tapered with the distance from the input part in the flow direction of the current input from the input part in accordance with the current value of the current flowing in the linking plate.

4. The fuse circuit assembly according to claim 3, wherein the thickness of the linking plate is substantially uniform in the flow direction of the current input from the input part.

5. The fuse circuit assembly according to claim 1, wherein the thickness of the linking plate is substantially uniform in the flow direction of the current input from the input part.

* * * * *